United States Patent [19]

Viesturs

[11] 3,943,645

[45] Mar. 16, 1976

[54] SELF-SUPPORTING TRANSPARENT JACKET FOR DATA SHEETS OR THE LIKE

[76] Inventor: Eric A. Viesturs, c/o Connecticut Aircraft Corp., 41 Monroe Turnpike, Trumbull, Conn. 06611

[22] Filed: Nov. 7, 1972

[21] Appl. No.: 304,395

Related U.S. Application Data

[63] Continuation-in-part of Ser. No. 48,029, June 22, 1970, abandoned.

[52] U.S. Cl. ..... 40/10 D; 40/159; 150/39

[51] Int. Cl.[2] ..... G09F 3/18

[58] Field of Search ..... 40/159, 158, 158 B, 16, 40/10, 104.18, 104.19; 150/39, 52 B; 281/34

[56] References Cited

UNITED STATES PATENTS

| | | | |
|---|---|---|---|
| 942,669 | 12/1909 | Sauerwein et al. | 40/159 |
| 1,736,950 | 11/1929 | Wangemann | 40/159 |
| 2,725,913 | 12/1955 | Horwin | 150/39 X |
| 2,861,369 | 11/1958 | Widmaier | 40/159 |
| 2,898,257 | 8/1959 | Carver | 40/2.2 |
| 2,925,675 | 2/1960 | Lumpkin | 40/159 X |
| 2,952,087 | 9/1960 | Chamberlin | 40/159 |
| 2,977,698 | 4/1961 | Chamberlin | 40/159 |
| 3,238,655 | 3/1966 | Engelstein | 40/159 |
| 3,363,346 | 1/1968 | Wittboldt | 40/2.2 |

FOREIGN PATENTS OR APPLICATIONS

| | | | |
|---|---|---|---|
| 1,429,428 | 1/1966 | France | 150/39 |

*Primary Examiner*—Louis G. Mancene
*Assistant Examiner*—Wenceslao J. Contreras
*Attorney, Agent, or Firm*—H. Gibner Lehmann; K. Gibner Lehmann

[57] ABSTRACT

A self-supporting transparent plastic jacket for mounting and protecting display and advertising sheets, small and large photographic prints, stamps, coins, price tags, shelf labels, advertising posters, data cards and the like, and for attaching the same to supporting surfaces. The jacket comprises a transparent thermoplastic front panel which has at the back of its opposite border portions several separate, elongate, ribbon-like border strips. At least one of the strips is electronically heat sealed to the front panel along three corresponding edge portions, so as to form a shallow, receiving, pocket-like space in which one edge area of the sheet or card may be inserted to enable the card to be held flatwise behind the front panel of the jacket. The rear exposed surfaces of the border strips are provided with a pressure-sensitive adhesive and with release paper or sheet material covering the adhesive. After insertion of the data sheet, card, picture or the like, the release paper is peeled from the border strips, revealing the pressure-sensitive adhesive whereby the jacket having the data card inserted in it may be easily and quickly applied to any supporting surface.

1 Claim, 16 Drawing Figures

INVENTOR.
ERIC A. VIESTURS
BY
H. Gibner Lehmann
AGENT

SELF-SUPPORTING TRANSPARENT JACKET FOR DATA SHEETS OR THE LIKE

Cross References To Related Applications

The present application is a continuation-in-part of my copending application entitled "Self-Supporting Transparent Jacket for Data Sheets, Cards, Photographic Prints or the Like", Ser. No. 48,029, filed June 22, 1970, which is about to be abandoned.

BACKGROUND

This invention relates to transparent plastic envelopes, jackets or the like intended to receive, display and protect small and large sheets or cards containing information, photographic prints and the like, and more particularly to envelopes or jackets of this type which are self-supporting in that they are provided on a rear surface with a pressure-sensitive adhesive by which the jacket and its contents may be readily mounted on a supporting surface.

Heretofore, various types of transparent envelopes have been proposed and produced, arranged to receive photographs, cards or the like and to display the latter while at the same time protecting them, said envelopes being adapted by means of pressure-sensitive adhesive to be applied to supporting surfaces. These envelopes, jackets, etc. in many cases have been mass-produced by utilizing strip or web-like material coming from supply rolls. While the cost of such envelopes has in general been held to a low figure, they have had a number of drawbacks. In one type of envelope, two plastic panels were joined along all four marginal portions, and a slit was provided in the back panel to enable the insertion of a packing slip, data card, or the like. Other types of envelopes involved the folding of large panel areas, the applying of pressure-sensitive adhesive to selected portions of back areas of the envelopes, and the forming of more or less complicated shapes wherein the fabricating cost became a considerable factor, or else the inconvenience of the operations required of the ultimate user or consumer became unduly great.

SUMMARY

The above drawbacks and disadvantages of prior envelopes, jackets and the like are obviated by the present invention, which has for one object the provision of a novel and improved self-supporting transparent jacket for holding, protecting and mounting both small and large sheets, pictures, cards, stamps, coins, price tags, shelf labels, advertising posters and the like wherein the insertion of the picture, sheet, card or other article may be effected in the easiest and quickest possible manner, there being relatively few parts or components to the jacket and the operation of inserting the card or article and mounting the jacket on the supporting surface being of the utmost simplicity. A concurrent object of the invention is the provision of an improved self-supporting transparent jacket as above set forth, wherein the least amount of material is required, thereby reducing the material cost to the lowest possible figure. Another object is the provision of a transparent jacket which employs no solvent material and thus will not cause damage to the article being displayed therein. These objects are accomplished by the provision of a transparent thermoplastic front panel which is adapted to overlie the sheet, card, picture or other article which is to be protected while at the same time permitting it to be fully viewed. The front panel has along opposite, narrow, border portions at its back, a pair of separate, elongate, ribbon-like border strips forming at least one relatively shallow, pocket-like receiving space, the strips being heat-sealed along edge portions thereof to corresponding edge portions of the front panel. The exposed rear areas of the border strips are provided with pressure-sensitive adhesive which is temporarily covered by release paper or equivalent sheet material. By the provision of the shallow pocket-like space, the data card, picture or the like can most easily have an edge area inserted therein, whereby it becomes mounted in back of the front panel. This completes the entire operation of using the jacket, with the exception of thereafter peeling off the release paper or equivalent sheet material and applying the filled jacket to the desired supporting surfaces. By such construction the least possible amount of material is required, and the insertion of the card, picture, slip of paper or the like, is greatly facilitated, as well as is the exposing of the pressure-sensitive adhesive and the applying of the jacket to the desired surface.

Other features and advantages of the invention reside in the provision of an improved self-supporting transparent jacket as above set forth, which may be mass produced in continuous lengths, having various widths and sizes, and being so arranged that the ultimate jacket may have any desired length, cut to suit particular conditions of use.

Still other features and advantages will hereinafter appear, in the accompanying drawings wherein several embodiments of the invention are illustrated:

Figure 1:
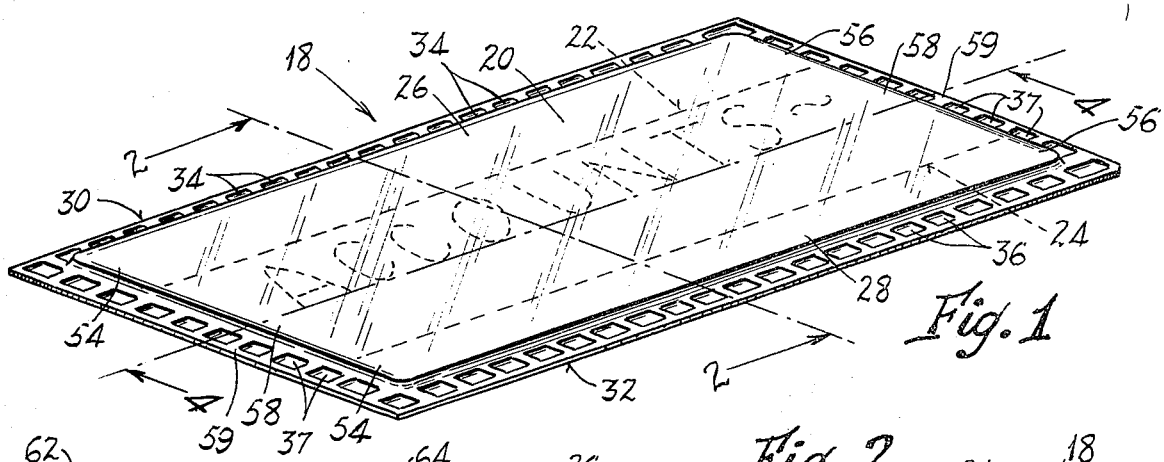
FIG. 1 is a perspective view of a single, self-supporting transparent jacket for small sheets, cards and the like, as provided by the invention.
Figure 2:
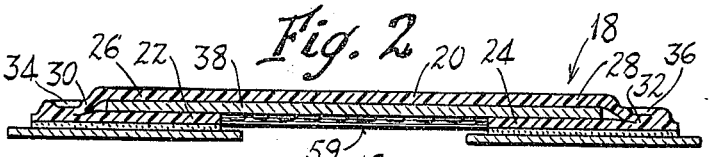
FIG. 2 is a transverse section taken on the line 2—2 of FIG. 1.
Figure 3:
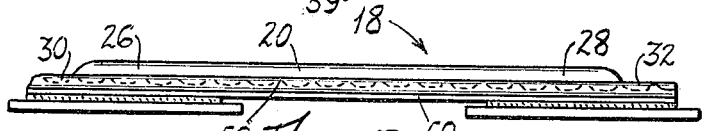
FIG. 3 is an end or edge elevational view of the jacket of FIGS. 1 and 2.
Figure 4:
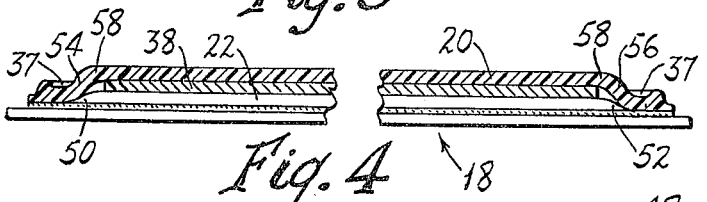
FIG. 4 is a longitudinal section taken on the line 4—4 of FIG. 1.

Considering first FIGS. 1–4, the novel and improved, self-supporting transparent jacket 18 as shown therein comprises a thin front or top panel 20 formed of thermoplastic resin material such as polyvinylchloride or polyurethane, said panel being illustrated as having a rectangular configuration. As shown in FIGS. 2 and 4, the jacket 18 includes a pair of separate, elongate, ribbon-like border strips 22, 24 extending along and to the rear of opposite, narrow border portions 26, 28 respectively of the front panel 20. The border strips 22, 24 are secured to the corresponding side edge portions 30, 32 respectively of the front panel 20 by means of an electronic heat-sealing operation involving an electronic heat-sealing die which produces a plurality of heat-sealed joints by inducing heat and pressure to the superposed edge portions of the panel and border strips, fusing and joining the border strips along one elongate narrow edge portion and two transverse narrow edge portions thereof to narrow edge portions of the front panel so as to form two shallow, receiving pocket-like spaces capable of securing an edge of the display article from three sides. The heat-sealing operation leaves an impression and causes an extrusion of the thermoplastic material, creating configured surface areas comprising a plurality of small depressed squares or rectangles 34, 36, commonly known in the trade as a stitch pattern. However, other patterns or else a solid seal may be utilized instead, as can be understood. Although in FIGS. 2 and 4 the elongate border strips 22, 24 are shown as not only being parallel with the front panel 20 but also spaced to the rear thereof, this positioning occurs due to the interposition between the panel and the border strips of the display sheet, card or picture 38. Prior to such interposition or insertion of the card 38, the border strips 22, 24 closely underlie and engage the bottom or under surface of the front panel 20 in a manner similar to that illustrated in FIG. 9, where there is shown a front panel 40 provided with a pair of elongate integral folded border strips 42, 44 which are secured to the opposite side edge portions 46, 48 of the panel 40 in a manner to be described later. As shown in FIG. 2, the thickness of the border strips 22 and 24 is measurably less than the thickness of the front panel 20. By way of example, depending on the surface area or size, the front panel could have a range of thickness of from 4–20 thousandths of an inch and the border strips 22–24 could be relatively dimensioned to fall within the range of from 3–8 thousandths of an inch. Also, the border strips can be transparent, such that a display article can be viewed from the rear through the transparent border strip when the jacket is supported on a glass surface and is visible from both sides thereof.

Referring again to FIGS. 1–4, it will be understood that the front panel 20 and the border strips 22, 24 are flexible or resilient, whereby separation by flexing of the border strips from the front panel 20 can easily be effected to enable insertion of the display sheet or card 38.

Further, in accordance with the present invention as seen in FIG. 4, the edge portions 50, 52 of the border strips 22, 24 are electronically heat-sealed to corresponding edge portions 54, 56 of the front panel 20.

With such arrangement, each of the elongate border strips 22, 24 in conjunction with the transparent front panel 20 forms a long and shallow pocket-like receiving space or pocket, so to speak, in which a marginal or edge area of the display sheet or card 38 can be received and secured on three sides.

From an inspection of FIGS. 1–4 it will be noticed that the fusing and electronic heat-sealing of the marginal portions of the front panel 20 to the border strips 22, 24 results in the entire front panel being disposed in a raised position with respect to its border portions, and this is true of the central end portions 58 of the front panel even though there are no underlying broder strips at these places. In accordance with the present invention, the fusing and heat-forming tool not only engages the opposite longitudinal edge portions of the front panel 20, but it also engages and forms the opposite transverse edge or end portions 54, 56 and 58 of the front panel with the result that the latter occupies a raised plane, so to speak, as illustrated in FIGS. 1–4. It will be seen in FIGS. 1 and 2 that the end portions 59 of the front panel 30 are in a lower plane than the panel, as a result of the heat-sealing and forming operation performed by the electronic heat-sealing tool. The stitch pattern configuration comprising the small square or rectangular depressions 34, 36 (and 37) at the side margins and transverse or end margins of the jacket provide a desirable ornamental appearance in addition to joining together the panel and border strips for the purpose of providing the oppositely-located, longitudinally-extending shallow pockets in which the opposite longitudinal edge portions of the sheet or card 38 are disposed. The border portions of the front panel are thus characterized by alternating thin and thick fused portions, the material thickness of the thick fused areas being greater than the material thickness at the thin fused areas. By this arrangement, a fused juncture is formed which has a strength greater than the strength of a continuously fused tin juncture alone. Also, it is to be noted that those edges of the front panel not adjacent the border strips are characterized by thick and thin fused portions to impart a non-planar configuration to the panel, such that increased rigidity thereof is realized.

The jackets 18 can be formed by using front panel stock having the exact width shown, or by using front panel stock having multiples of the width shown in which latter case a number of jackets 18 will be disposed side-by-side and can be separated by being cut apart, or by being torn apart if weakened tear lines are made during the heat-forming operation. Thus, a unit containing 6 or 8 or more joined jackets 18 can be formed by a single heat-sealing operation and can be cut at that time or else cut or torn apart at a later time.

Figure 5:
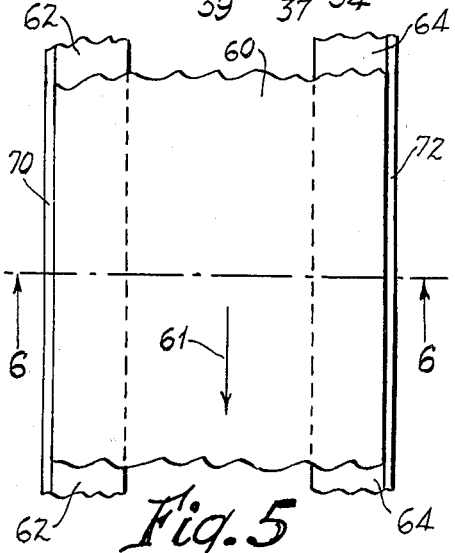
FIG. 5 is a fragmentary plan view of portions of the jacket during the process of its fabrication.
Figure 6:
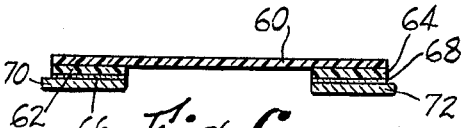
FIG. 6 is a transverse section taken on the line 6—6 of FIG. 5.
Figure 7:
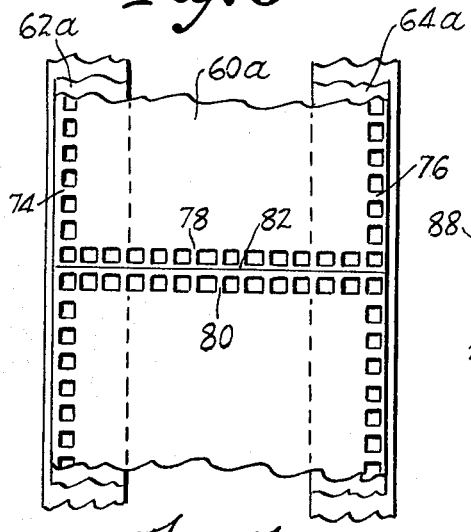
FIG. 7 is a fragmentary plan view of the jacket portions of FIGS. 5 and 6, illustrating the result of a subsequent heat-sealing operation.

Steps in the fabrication of the self-supporting jacket 18 may be carried out as illustrated in FIGS. 5, 6 and 7. In FIG. 5 a web 60 of transparent thermoplastic material can be fed as indicated by the arrow 61 from a supply roll (not shown) and superposed over a pair of spaced parallel narrow thermoplastic border strips or webs 62, 64. The border strips 62, 64 may thereafter be provided with pressure-sensitive coatings 66, 68 of adhesive to which there is thereafter applied strips of release paper 70, 72. This assemblage may be fed past an electronic heat-sealing station having an electronic heat-sealing and forming die which then fuses and forms corresponding edge portions of the assemblage, in the manner illustrated in FIG. 7. In this figure, the longitudinal fused portions are indicated by the numerals 74, 76, and the transverse fused or sealed portions indicated by the numerals 78, 80. Between the transverse fused portions 78, 80 there is formed a thin tear line 82 which enables the fused and sealed web to be easily separated into individual jackets by a simple tearing operation, or else enables the completed web to be zig-zag folded into a stack, whichever may be desired. The fused front panel web is indicated by the numeral 60*a*, and the fused narrow webs by the numerals 62*a* and 64*a*. The fusing and heat-sealing of the front panel member or web 60 to the border strips 62, 64 can be effected after the border strips have been provided with the pressure-sensitive adhesive coatings 66, 68 and the release paper strips 70, 72. That is, the composite border strips comprising the plastic, pressure-sensitive coating and release paper may be fed along with and under the front panel webs 60 and thereafter the fusing and heat-sealing operation performed to provide the sealed and segmented end product shown in FIG. 7. Or, the fusing and heat-sealing of the front panel 60 may be effected to the border strips 62, 64 prior to the application of the pressure-sensitive adhesive and release paper to the border strips.

As illustrated in FIGS. 5 and 6, it can be seen that the width of each of the border strips 62, 64 is substantially less than one-half the distance between the opposite narrow border portions of the front panel 60. Such a construction provides two distinct advantages. First, by employing strips of relatively narrow width, a substantial saving of material is realized over the use of wider widths. Second, the narrow strips facilitate the insertion of the card, data sheet, stamp or the like into the jacket since less bending of the latter is required during the insertion step.

Figure 9:
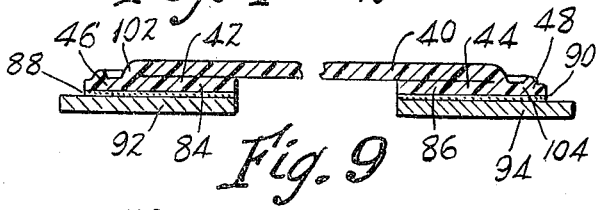
FIG. 9 is a fragmentary transverse sectional view of the jacket components of FIG. 8, after the performing of a folding and heat-forming operation thereon.
Figure 10:
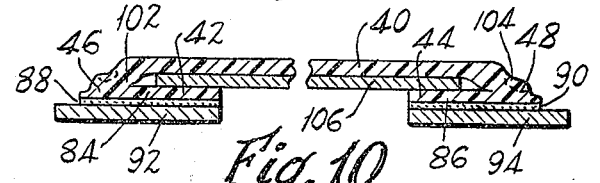
FIG. 10 is a transverse fragmentary sectional view similar to that of FIG. 9, after a sheet or card has been inserted in the jacket and prior to the latter being adhered to a supporting surface.
Figure 8:
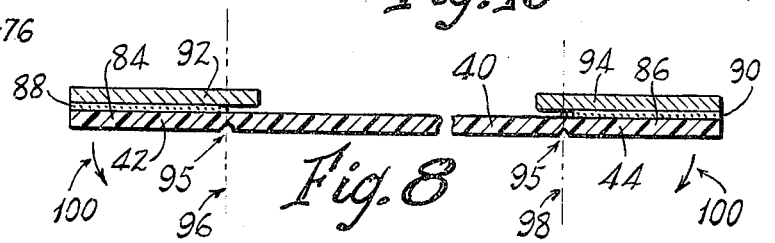
FIG. 8 is a fragmentary transverse sectional view of a composite web formed by an initial series of operations, constituting a jacket representing another embodiment of the invention.

In the embodiment of the invention illustrated in FIGS. 8–10, a transparent thermoplastic front panel web 40 is provided along opposite side marginal portions 84, 86 thereof with pressure-sensitive coatings 88, 90 respectively, over which there are applied release paper strips 92, 94. If desired, the front panel web 40 may have longitudinal lines of weakness 95 at locations indicated by broken lines 96, 98 as seen in FIG. 8. After the assemblage of FIG. 8 has been effected, it is longitudinally folded along longitudinal lines indicated by the broken lines 96, 98 in the direction indicated by the arrows 100 to bring the marginal portions 84, 86 so that they underlie the front panel web 40 as shown in FIG. 9. Thereafter, the heat-forming operation is performed on opposite marginal portions 102, 104 of the folded assemblage to provide a cross sectional configuration as illustrated in FIG. 9. This may be done by using heated rollers or equivalent devices. Optionally, a fusing and heat-sealing operation can also be performed to include transverse portions such as those indicated at 78, 80 in FIG. 7, thereby to form a series of shallow elongate longitudinally extending pockets along the side marginal portions of the panel 40. A data sheet or card 106 can have its opposite marginal portions inserted in the said pockets as shown in the transverse sectional view of FIG. 10.

It will be understood that after the jacket has been provided with the insert sheet or card 106, it is mounted on a supporting surface by the simple operation of peeling off the release paper strips 92, 94 to expose the pressure-sensitive adhesive on the border strips 42, 44 of the jacket. Thereafter, the jacket with the exposed pressure-sensitive adhesive may be applied to any surface easily and quickly, whereby it becomes self-supporting and displays in full view the enclosed card while at the same time protecting the surface thereof.

Figure 11:
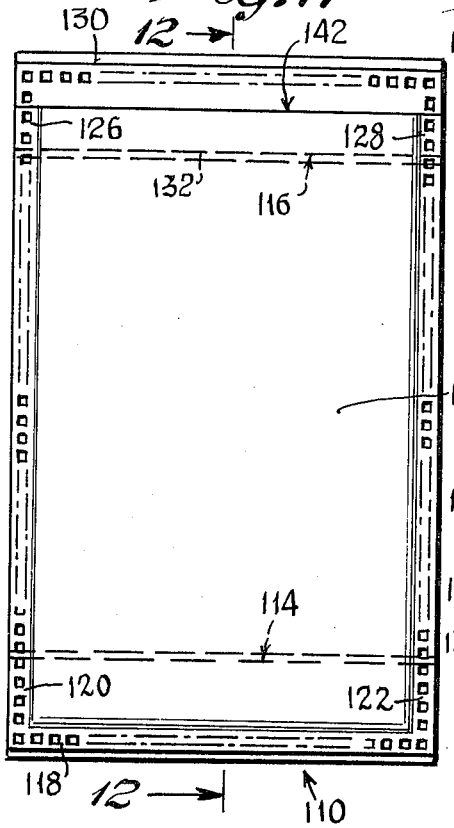
FIG. 11 is a top plan view of a modified jacket, constituting another embodiment of the invention, the jacket enabling the display article to be inserted therein after the jacket is in place.
Figure 12:
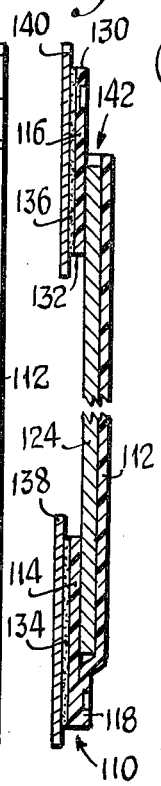
FIG. 12 is a broken section taken on line 12—12 of FIG. 11, somewhat enlarged for clarity of illustration.

Another embodiment of the invention is illustrated in FIGS. 11 and 12, illustrating a self-supporting jacket 110 having a transparent front panel 112 and a pair of transparent, elongate border strips 114 and 116. In accordance with the present invention, the border strips and front panel are constituted of polyvinylchloride or polyurethane. Border strips 114 is secured to the front panel by means of an electronically heat-sealed, fused joint along one elongate narrow edge portion 118 and two transverse edge portions 120 and 122 so as to form a pocket-like receiving space to hold the edge of the article to be displayed on three sides, the article being indicated by the numeral 124 in FIG. 12. The other border strip 116 is electronically heat-sealed to the front panel 112 along two transverse edge portions 126 and 128, but has both elongate edge portions 130, 132 free. In addition, the border strip 116 extends beyond the adjoining edge of the front panel 112 so as to be exposed at the front of the jacket. The back surfaces of the border strips 114 and 116 have coatings 134, 136, respectively of pressure sensitive adhesive, and are provided with strips of release paper 138, 140 which may be removed and discarded immediately prior to installation of the jacket. By the above arrangement, the jacket is accessible from the front, through opening 142, enabling an article to be readily inserted or removed after the jacket has been placed on its supporting surface (not shown).

Figure 13:
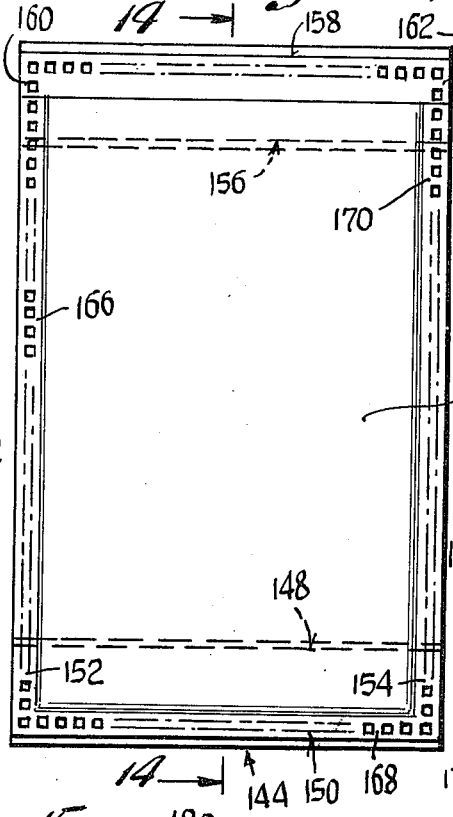
FIG. 13 is a top plan view of a further modified jacket, constituting still another embodiment of the invention.
Figure 14:
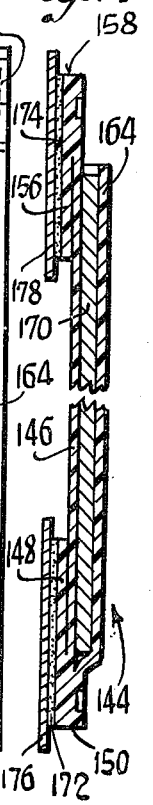
FIG. 14 is a broken section taken on line 14—14 of FIG. 13, somewhat enlarged for clarity of illustration.

Another embodiment of the invention is illustrated in FIGS. 13 and 14, showing a jacket 144 having a front panel 146, a border strip 148 electronically heat-sealed along one elongate edge portion 150 and two transverse edge portions 152 and 154 to the front panel, and an additional border strip 156 electronically heat-sealed to the front panel along edges 158, 160 and 162, as well as an additional, rectangular, transparent, thermoplastic panel 164 of polyvinylchloride or polyurethane superposed on the front panel and overlying the same. The panel 164 is electronically heat-sealed to the panel 146 along three edges 166, 168 and 170. By this arrangement, there is formed a pocket-like receiving space between the panels 146 and 164 to receive the display article 170, which may be readily inserted and removed after the jacket 144 has been installed on a supporting surface. The border strips have adhesive coatings 172, 174 and release paper 176, 178, respectively.

Figure 15:
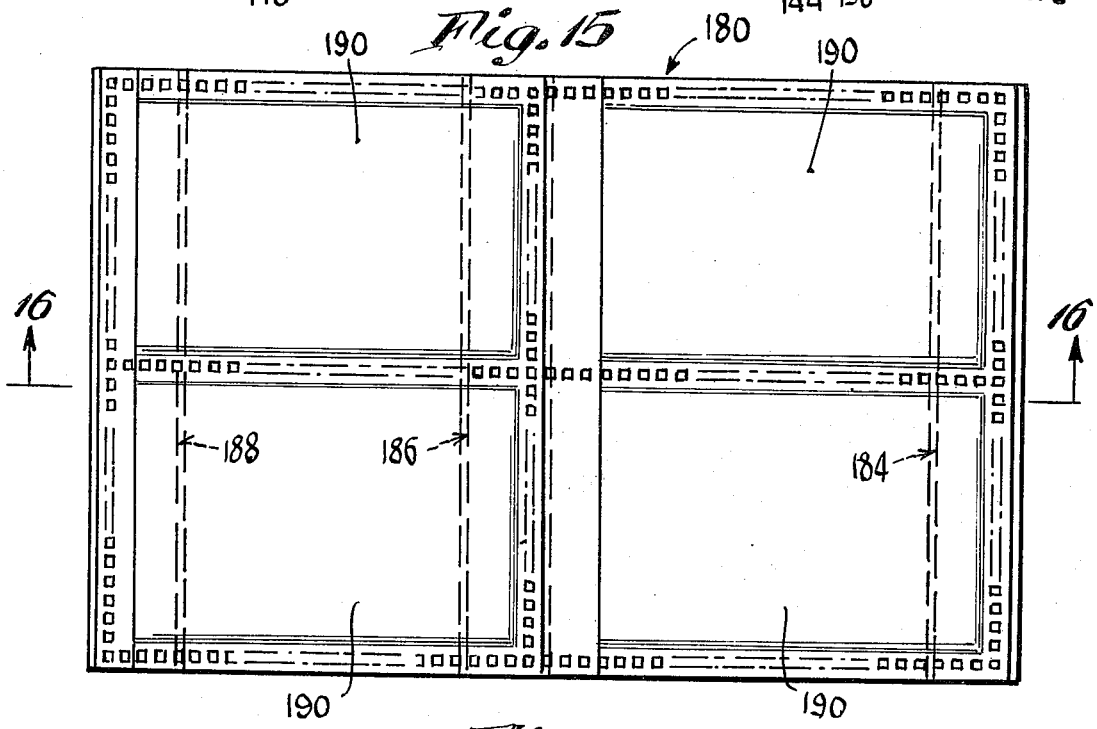
FIG. 15 is a top plan view of a still further modified jacket for simultaneously storing or displaying a plurality of display articles, the jacket constituting still another embodiment of the invention.
Figure 16:
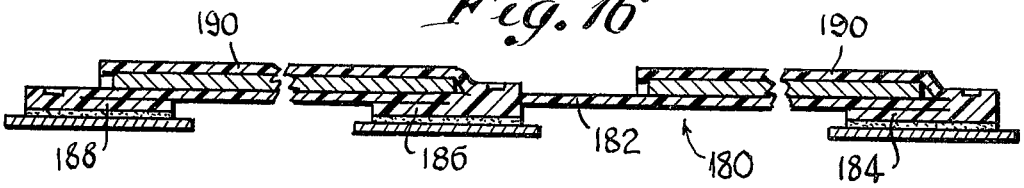
FIG. 16 is a broken section taken on line 16—16 of FIG. 15, somewhat enlarged for clarity of illustration.

Still another embodiment of the invention is illustrated in FIGS. 15 and 16, illustrating a jacket 180 having a plurality of pockets for receiving a number of display articles and storing or displaying them simultaneously. The jacket includes a panel 182 and adhesive-backed border strips 184, 186, 188 electronically heat-sealed thereto, and overlying panels 190, electronically heat-sealed to the panel 182 at the locations of the border strips. The jacket can be either transparent or opaque. In the latter case, the jacket would be employed only for storage and not for display of a number of card-like articles. The heat-sealing operation can be performed on a single sheet of substantial expanse which has been superimposed upon the panel 182, and thereafter the sheet can be cut to form the panels 190 as shown. This jacket also enables one to readily insert or replace articles from the front even after it has been adhered to a supporting surface.

It will now be understood from the foregoing that I have provided a novel and improved, especially simple and effective self-supporting transparent jacket which may be economically fabricated in continuous strip form, and cut later by a process involving the least possible cost. The fabricated composite web can be formed in a manner to have multiple rows of joined jackets. The composite web can be used to support a plurality of display articles, or can be severed along longitudinal tear lines or else severed along transverse tear lines, in each case producing individual jackets which are ready for storage, shipping and use; or else a continuous web may be zig-zag folded or else wound into rolls, to include a specified number of jackets, for storage, shipping and severance prior to use by the ultimate consumer. The jackets may be readily made in wider or narrower sizes, and also may have any desired length, as will be understood. Relatively little material is involved in the fabrication of the jackets, and the insertion of the display sheet or card in the shallow pockets may be easily and quickly effected, without difficulty, due to the nature of the pockets at the back and also due to the fact that the pressure-sensitive adhesive is normally covered with the release paper. After insertion of the data sheet or card, the release paper is then peeled off, placing the jacket in condition for application to a supporting surface. The use of electronic heat-sealing to fabricate joints between the border strips and the front panel has the advantage of providing a strong bond without the use of solvents which could conceivably become spilled onto the transparent face of the front panel and cause undesirable clouding thereof. In addition, since no solvents are employed, there is eliminated the danger of possible damage to the article to be viewed. The jacket of the present invention is thus seen to represent a distinct advance and improvement in this field.

Variations and modifications are possible without departing from the spirit of the invention.

I claim:

1. A self-supporting transparent jacket for mounting and protecting display articles such as stamps, coins, samples of material, photographic prints, small or large sheets or cards and the like having information contained thereon, and for attaching said articles to a supporting surface, comprising in combination:

a. a single, rectangular, transparent thermoplastic front panel of material selected from the group consisting of polyvinylchloride and polyurethane, said front panel being adapted to overlie the article and protect the same while permitting it to be fully viewed, b. a pair of separate, elongate, ribbon-like border strips extending respectively along the back of one pair of opposite narrow border portions of the front panel, c. means securing the border strips along at least one elongate narrow edge portion and each along two transverse narrow edge portions thereof to corresponding narrow edge portions of the front panel so as to form a shallow, pocket-like receiving space thereby which is located at one border portion of the front panel, thereby to lock in the display article along three sides, d. said securing means being characterized by extrusion of the material and comprising electronically heat-sealed and formed joints between said edge portions of the border strips and edge portions of said front panel, said joints being permanently deep-fused and presenting configured surface areas at the front of the jacket, e. inner portions of said border strips underlying and being coextensive with said narrow border portions of the front panel, said inner portions of the border strips being free of said narrow border portions whereby a sheet-like article of the proper size can have one of its edge areas inserted and interposed between said front panel and one of said border strips in the shallow receiving space formed thereby, so as to positively postition the sheet-like article along three adjoining sides with its front face in full view behind the front panel, f. a pressure-sensitive adhesive coating on the back surfaces of at least one of the border strips, g. release paper temporarily covering and adhered to said pressure-sensitive adhesive coating, h. the width of the elongate ribbon-like border strips being each substantially less than one-half the distance between said opposite narrow border portions of the rectangular front panel, i. said electronically heat-sealed and formed joints of the front panel and border strips being constituted of the narrow edge portions thereof, which edge portions are heat-fused to one another and which constitute the said securing means, j. one of said border strips having both of its elongate, narrow edge portions free and unattached, k. said one border strip along its entire length extending beyond the adjoining edge of the front panel so as to be exposed at the front of the jacket, thereby to enable a display article to be readily inserted behind the front panel and in front of said one border strip, with the jacket in place on a supporting surface.

* * * * *